United States Patent [19]

Flemings et al.

[11] 3,948,650

[45] Apr. 6, 1976

[54] COMPOSITION AND METHODS FOR PREPARING LIQUID-SOLID ALLOYS FOR CASTING AND CASTING METHODS EMPLOYING THE LIQUID-SOLID ALLOYS

[75] Inventors: Merton C. Flemings, Cambridge; Robert Mehrabian, Arlington; David B. Spencer, Bedford, all of Mass.

[73] Assignee: Massachusetts Institute of Technology, Cambridge, Mass.

[22] Filed: July 17, 1973

[21] Appl. No.: 379,991

Related U.S. Application Data

[63] Continuation-in-part of Ser. No. 258,383, May 31, 1972, abandoned, which is a continuation-in-part of Ser. No. 153,819, June 16, 1971, abandoned.

[52] U.S. Cl. ..... 75/135; 75/10 R; 75/65 R

[51] Int. Cl.[2] ..... C22C 1/02; C22B 4/06

[58] Field of Search ..... 75/10, 65, 20 F, 129, 135, 75/130.5

[56] References Cited

UNITED STATES PATENTS

| | | | |
|---|---|---|---|
| 2,793,949 | 5/1957 | Imich | 75/135 |
| 3,189,444 | 6/1965 | Olds | 75/148 |
| 3,300,296 | 1/1967 | Hardy | 75/20 |
| 3,620,686 | 11/1971 | Pfann | 75/1.6 |

*Primary Examiner*—Peter D. Rosenberg
*Attorney, Agent, or Firm*—Arthur A. Smith, Jr.; Martin M. Santa; Robert J. Horn, Jr.

[57] ABSTRACT

A metal composition characterized by degenerate dendritic or nodular primary discrete solid particles suspended in a secondary phase having a lower melting point than the primary particles and which secondary phase can be solid or liquid. The method involves raising the temperature of a metal alloy to a value at which the alloy is largely or completely in the molten state. The melt then is subjected to vigorous agitation and the temperature is reduced to increase the portion of the mixture in solid degenerate dendrite or nodular form up to about sixty-five percent, but usually up to about fifty percent, while continuing the agitation. At this juncture the temperature of the liquid-solid composition can be reduced to cause solidification thereof or it can be cast. The solidified composition can be stored and later it can be brought again to the liquid-solid mixture state and then recast.

33 Claims, 6 Drawing Figures

FIG. 3

COMPOSITION AND METHODS FOR PREPARING LIQUID-SOLID ALLOYS FOR CASTING AND CASTING METHODS EMPLOYING THE LIQUID-SOLID ALLOYS

The invention herein described was made in the course of work performed under Contract No. DAHC 04-70-C-0063 with the Department of the Army.

This application is a continuation-in-part of application Ser. No. 258,383, filed May 31, 1972, and now abandoned, which in turn is a continuation-in-part of Ser. No. 153,819, filed June 16, 1971, and now abandoned.

The present invention relates to a metal composition and to a method of preparing a liquid-solid metal composition for a casting or forming process and to a casting or forming process employing such a liquid-solid metal composition.

Existing casting methods in which a metal is brought to a liquid state and then poured or forced into a mold have a number of shortcomings. The shrinkage in changing state from when the liquid changes to solid shrinkage of about five percent is encountered and the cooling process is fairly long. Furthermore, the fully liquid melt is highly erosive to dies and molds and the high temperature of the liquid and its erosive characteristics make difficult of impossible die casting of some high temperature alloys such as, for example, copper or iron alloys. The foregoing shortcomings can be alleviated by casting a liquid-solid mixture of such alloys, and the principle object of the present invention is to provide a method of preparing such a mixture.

Another object is to provide methods of casting that employ such a mixture.

Still another object is to provide pure metal or alloy compositions useful in forming or casting processes.

These and other objects are discussed in the description of the invention to follow and are particularly pointed out in the appended claims.

Broadly, the objects of the invention are embraced by a method of preparing liquid-solid mixtures for use in a casting process, that comprises, raising the temperature of an alloy to-be-cast to a value at which most or all the alloy is in the liquid state and vigorously agitating the melt thereby formed. The temperaure of the melt is then reduced while agitation continues to increase the fraction solid comprising discrete degenerate dendrites or nodules while avoiding the formation of a dendritic network. The percentage solid can be as high as sixty-five percent, but it is usually kept at about forty to fifty percent. At forty percent solid the liquid-solid slurry has a viscosity of about one to ten poise. At this juncture the melt can be cast or it can be cooled rapidly to effect complete solidification for storage and later use.

This invention also provides a metal composition which can be either solid or partially solid and partially liquid and which comprises primary solid discrete particles and a secondary phase. The secondary phase is solid when the metal composition is solid and is liquid when the metal composition is partially solid and partially liquid. These compositions can be formed from a wide variety of metals or metal alloy compositions. The primary particles comprise small degenerate dendrites or nodules which are generally spheroidal in shape and are formed as a result of agitating the melt when the secondary phase is liquid. The primary solid particles are made up of a single phase or plurality of phases having an average composition different from the average composition of the surrounding matrix, which matrix can itself comprise primary and second phases upon further solidification.

By the term "primary solid" as used herein is meant the phase or phases solidified to form discrete degenerate dendrite particles as the temperature of the melt is reduced below the liquids temperature of the alloy into the liquid-solid temperature range prior to casting the liquid-solid slurry formed. By the term "secondary solid" as used herein is meant the phase or phases that solidify from the liquid existing in the slurry at a lower temperature than that at which the primary solid particles are formed after agitation ceases The primary solids obtained in the composition of this invention differ from normal dendrite structures in that they comprise discrete particles suspended in the remaining liquid matrix. Normally solidified alloys, in absence of agitation, have branched dendrites separated from each other in the early stages of solidification i.e. up to 15 to 20 wt. percent solid, and develop into an interconnected network as the temperature is reduced and the weight fraction solid increases. The structure of the composition of this invention on the other hand prevents formation of the interconnected network by maintaining the discrete primary particles separated from each other by the liquid matrix even up to solid fractions of 60 to 65 wt. percent. The primary solids are degenerate dendrites in that they are characterized by having smoother surfaces and less branched structures which approaches a spherical configuration than normal dendrites and may have a quasi-dendritic structure on their surfaces but not to such an extent that interconnection of the particles is effected to form a network dendritic structure. The primary particles may or may not contain liquid entrapped within the particles during particle solidification depending upon severity of agitation and the period of time the particles are retained in the liquid-solid range. However, the weight fraction of entrapped liquid is less than that existing in a normally solidified alloy at the same temperature employed in the present processes to obtain the same weight fraction solid.

The secondary solid which is formed during solidification from the liquid matrix subsequent to forming the primary solid contains one or more phases of the type which would be obtained during solidification of a liquid alloy of identical composition by presently employed casting processes. That is, the secondary solid can comprise dendrites, single or multiphase compounds, solid solutions, or mixtures of dendrites, compounds and/or solid solutions.

The size of the primary particles depends upon the alloy or metal compositions employed, the temperature of the solid-liquid mixture and the degree of agitation employed with larger particles being formed at lower temperature and when using less severe agitation. Thus, the size of the primary particles can range from about 1 to about 10,000 microns. It is preferred that the composition contain between about 10 and 50 wt. percent primary particles since they have a viscosity which promotes ease of casting or forming without causing heat damage to the forming or casting apparatus.

The compositions of this invention can be formed from any metal alloy system or pure metal regardless of its chemical composition. Even though pure metals and eutectics melt at a single temperature, they can be employed to form the composition of this invention since they can exist in liquid-solid equilibrium at the melting point by controlling the net heat input or output to the melt so that, at the melting point, the pure metal or eutectic contains sufficient heat to fuse only a portion of the metal or eutectic liquid. This occurs since complete removal of heat of fusion in a slurry employed in the casting process of this invention cannot be obtained instantaneously due to the size of the casting normally used and the desired composition is obtained by equating the thermal energy supplied, for example by vigorous agitation and that removed by a cooler surrounding environment. Representative suitable alloys include magnesium alloys, zinc alloys, aluminum alloys, copper alloys, iron alloys, nickel alloys, cobalt alloys and lead alloys such as lead-tin alloys, zinc-aluminum alloys, zinc-copper alloys, magnesium-aluminum alloys, magnesium-aluminum-zinc alloys, magnesium-zinc alloys, aluminum-copper alloys, aluminum-silicon alloys, aluminum-copper-zinc-magnesium alloys, copper-tin bronzes, brass, aluminum bronzes, steels, cast irons, tool steels, stainless steels, super-alloys such as nickel-iron alloys, nickel-iron-cobalt-chromium alloys, and cobalt-chromium alloys,or pure metals such as iron, copper or aluminum.

This invention will now be discussed upon reference to accompanying drawings, in which.

Figure 3:
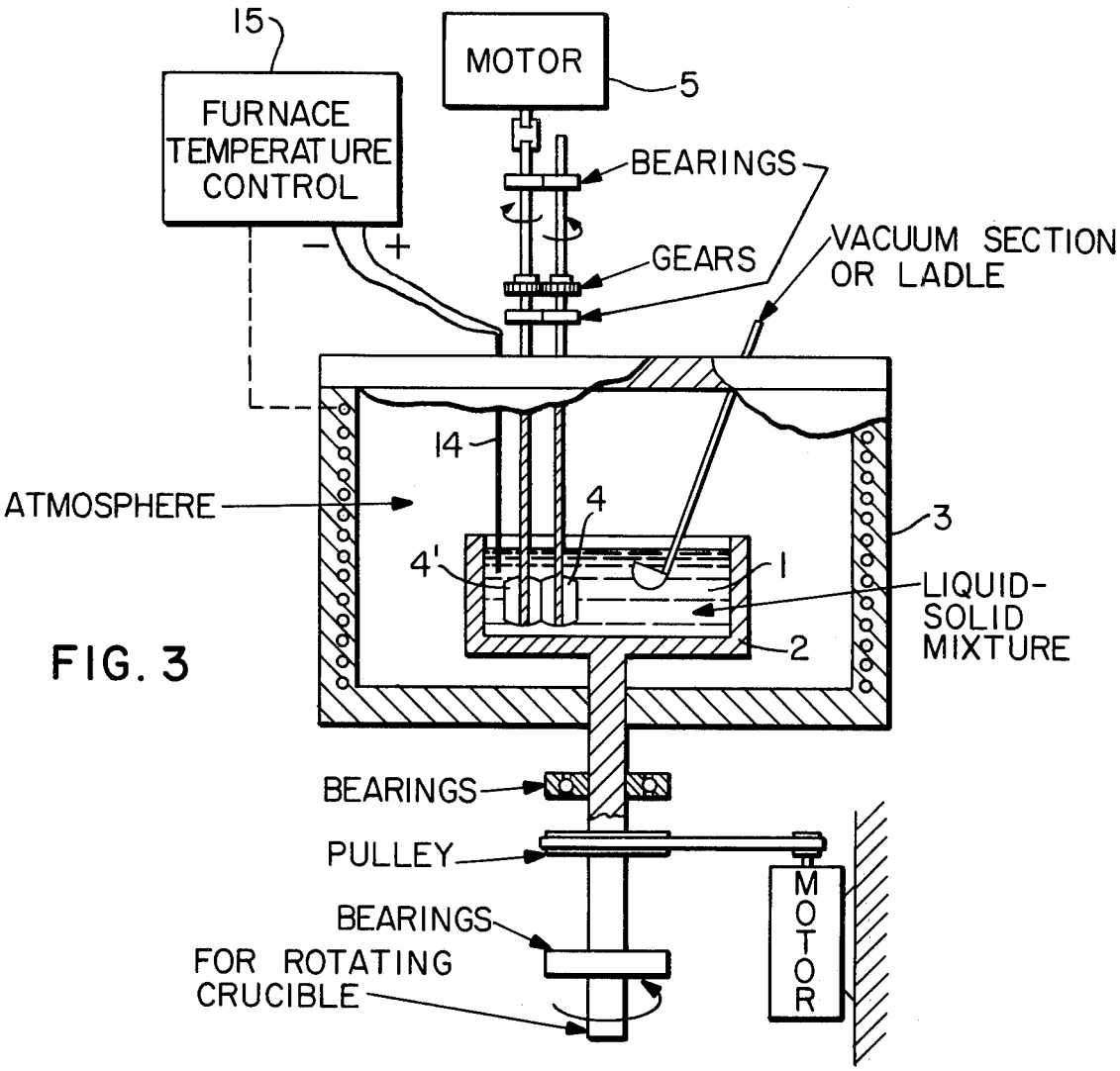
FIG. 3 is an elevation view, schematic in form and partially cut away, of apparatus adapted to practice the methods herein disclosed.

Turning now to the drawings, a liquid-solid mixture of metal alloys that solidify over a range of temperatures is shown at 1 in FIG. 3. The mixture is prepared by raising the temperature of the alloy in a crucible 2 within an electric furnace 3 until all of a substantial portion of the melt 1 is in the liquid state. At this juncture counter-rotating blades 4 and 4' are introduced into the melt 1 and caused to rotate at from 300 to 500 RPM by an electric motor 5 to effect vigorous agitation of the melt 1. The crucible 2 is also caused to rotate (but at the reduced speed of 5 to 10 RPM) by motor 6. Thereafter the temperature of the melt is reduced to effect some solidification or to effect additional solidification if some solid already exists. It is to be understood that temperature reduction and vigorous agitation need not be coextensive. The melt can be first cooled to form a small weight percentage of solids and then agitated to form the degenerate dendrites either with or without further cooling. The temperature can be reduced by employing the present teaching until up to about 65 percent primary solid exists in the mixture and then casting can be effected. At 60 percent solid the mixture viscosity is about 60 poise and it pours about like cement. At 40 percent primary solid the viscosity is about 4 poise and pours about like heavy machine oil at room temperature. The viscosity of 50 percent is about 20 poise. Viscosity measurements were on tin-15 percent lead mixtures. The values just given are for that particular alloy and degree of agitation and will differ somewhat when other alloys are employed. At this juncture the melt can be cast employing the usual techniques.

Figure 1:
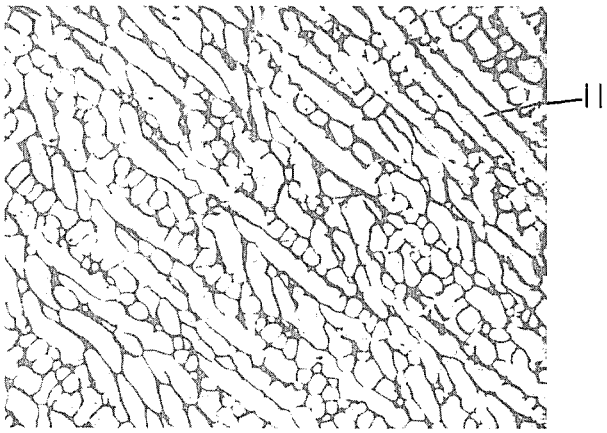
FIG. 1 is a reproduction of a photomicrograph showing the structure of a tin-ten percent lead casting made employing prior art techniques.
Figure 2:
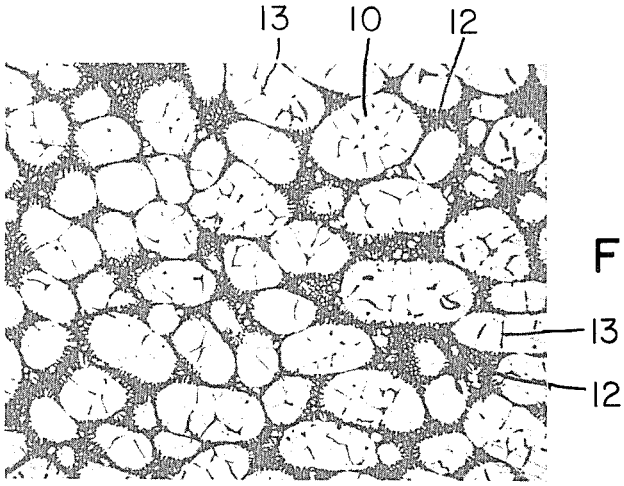
FIG. 2 is a reproduction of a photomicrograph showing the structure of tin-ten percent lead casting made employing the present teachings.

FIG. 2 is a reproduction of an actual photomicrograph showing th structure of a casting made of tin-10 percent lead which was agitated by the present technique and poured when the liquid-solid mixture was 65 percent primary solid. The globular-type primary solid metal formations 10 and secondary solids 12 in the casting are to be compared with the dendrite formations shown at 11 in FIG. 1. The black portion 13 of the primary solids 10 comprise liquid which was entrapped within the primary solid during its formation. The photomicrographs of FIGS. 1 and 2 were taken at ten times magnification.

Figure 4:
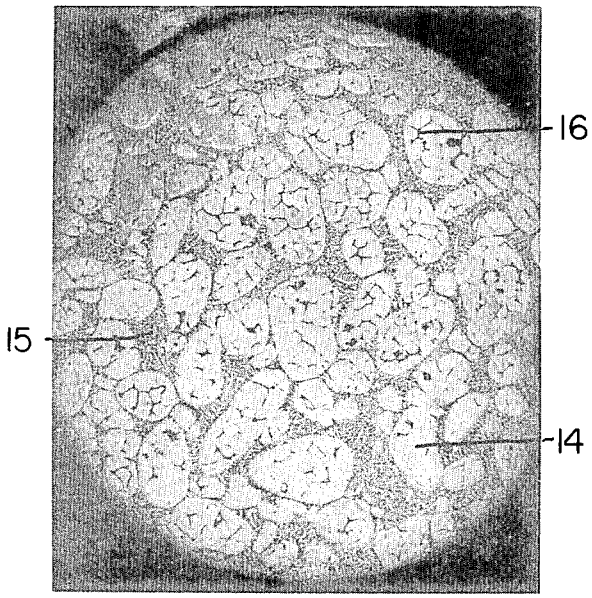
FIG. 4 is a reproduction of a photomicrograph showing the structure of a copper-ten percent tin casting made employing the present teachings.

FIG. 4 is a photomicrograph taken at 15 times magnification of copper-ten percent tin alloy casting which was cast from a composition containing about 50 wt. percent primary solids 14 and secondary solids 15. As can be readily observed by comparing FIGS. 1 and 4, the primary solids 14 contain entrapped liquid 16 and have a structure far different from the normal dendritic structure.

Figure 5:
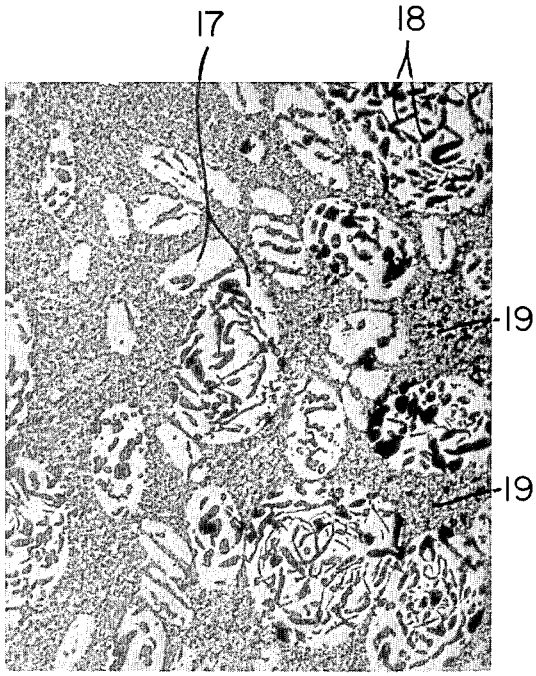
FIG. 5 is a reproduction of a photomicrograph showing the structure of an iron-three percent carbon-four percent silicon casting made employing the present teachings.

FIG. 5 is a photomicrograph, taken at 35 times magnification of an iron-three percent carbon-four percent silicon casting which was cast from a composition containing about 30 wt. percent primary solids 17 and secondary solids 19. The primary solids 17 contain entrapped liquid and graphite flakes 18 and have a non-dendritic structure.

Figure 6:
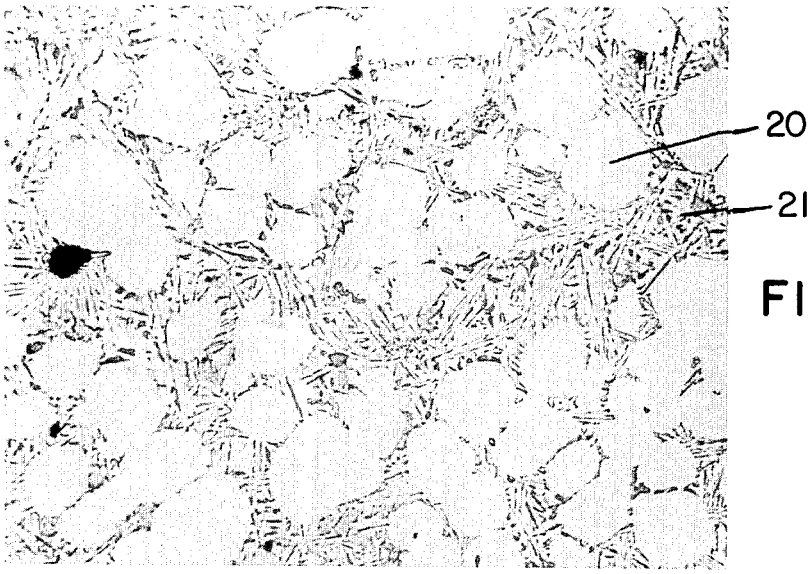
FIG. 6 is a reproduction of a photomicrograph showing the structure of an aluminum-8.5 percent silicon-3.5 percent copper-1 percent iron casting made employing the present teachings.

FIG. 6 is a photomicrograph taken at 50 times magnification of an aluminum-8.5 percent silicon-3.5 percent copper-1 percent iron casting containing about 40 wt. percent primary solids 20 and secondary solids 21. The primary solids 20 have a nondendritic structure.

The liquid-solid mixture 1 can, when the desired ratio of liquid-solid has been reached, be cooled rapidly to form a solid slug for easy storage. Later, the slug can be raised to the temperature of the liquid-solid mixture, for the particular ratio of interest, and then cast, as before, using usual techniques. A slug prepared according to the procedure just outlined possesses thixotropic properties when re-heated to the liquid-solid state. It can, thus, be fed into a modified die casting machine or other apparatus in aparently solid form. However, shear resulting when this apparently solid slug is forced into a die cavity causes the slug to transform to a material whose properties are more nearly that of a liquid. A slug having thixotropic properties also can be obtained by cooling the liquid-solid mixture to a temperature higher than that at which all of the liquid solidifies and the thixotropic composition obtained can be cast.

Liquid-solid mixtures were prepared employing apparatus like that shown in FIG. 3 and at speeds of five hundred RPM for the mixing blade. Temperature control of the furnace 3 was accomplished by using a thermocouple 14 to provide inputs to a furnace temperature control device represented by the block 15 in FIG. 3. The temperature of the liquid-solid at fifty percent solid for various alloys is given below:

| | | | |
|---|---|---|---|
| Sn - 10% Pb | 210°C | Alloy of FIG. 6 | 1020°F |
| Sn - 15% Pb | 195°C | Alloy of FIG. 4 | 947°C |
| Al - 30% Sn | 586°C | Alloy of FIG. 5 | about 1110°C |
| Al -4.5% Cu | 633°C | | |

Variations up or down from the fifty percent primary solid-liquid mixture will result from changes in the temperature values given.

A casting made using a 50-50 liquid-solid mixture has a shrinkage of about 2½ percent as distinguished from five percent for a wholly liquid metal—again the values given are for tin-lead alloys. Solidification shrinkages of some other metals are: iron 4.0 percent; aluminum 6.6 percent; and copper 4.9 percent.

Casting of the partially solidified metal slurry or mixture herein disclosed can be effected by pouring, injection or other means; and the process disclosed is useful for die casting, permanent mold casting, continuous casting, closed die forging, hot pressing, vacuum forming (of that material) and others. The special properties of these slurries suggest that modifications of existing casting processes might usefully be employed. By way of illustration, the effective viscosity of the slurries can be controlled by controlling fraction of primary solid; the high viscosities possible when the instant teachings are employed, result in less metal spraying and air entrapment in die casting and permits higher metal entrance velocities in this casting process. Furthermore, more uniform strength and more dense castings result from the present method.

The means by which agitation is effected, as shown in FIG. 3 and as before discussed, is counter-rotating blades, but electromagnetic stirring, gas bubbling and other agitation-inducing mechanisms can be employed. The agitation is sufficient to prevent the formation of interconnected dendritic networks or to substantially eliminate or reduce dendritic branches already formed on the primary solid particles. A discussion of the theory underlying this invention is contained in a doctoral thesis entitled "Rheology of Liquid-Solid Mixtures of Lead-Tin," by an inventor, Spencer, working with and under the supervision of the other two inventors herein. A number of the elements in the apparatus in FIG. 3 have self-explanatory legends applied, and it is believed no further explanation of their function is required herein.

In one aspect of the present invention, a metal-metal or metal-nonmetal composite composition is provided which comprises a metal or metal alloy matrix containing third phase solid particles homogeneously distributed within the matrix and having a composition different from the metal or metal alloy. The third phase particles are incorporated into the slurry compositions of this invention by adding them to the slurry and agitating the resulting composition until the third phase particles are dispersed homogeneously. The particles added as third phase particles to the slurry have a surface composition that is wet by the liquid portion of the metal to which it is added to effect its retention homogeneously within the metal matrix. As employed herein, a composition that is wet refers to compositions which, when added to a metal or metal alloy at or slightly above the liquidus temperature of the metal or metal alloy and mixed therein, as by agitation with rotating blades, for a suitable period of time to effect intimate contact therewith, e.g. about 30 minutes, are retained in measureable concentrations within the liquid after agitation thereof has ceased and the resultant composition is allowed to return to a quiescent state when the metal or metal alloy is at or slightly above the liquidus temperature. When third phase particles are incorporated into a metal or metal alloy which wets the particles at the liquidus temperature of the metal or metal alloy, the particles are retained therein in concentrations from a measurable concentration of slightly above 0 percent by weight, and generally up to about 5 percent by weight. Representative examples of wetting comprises a system including nickel-coated graphite in aluminum alloys, as disclosed by U.S. Pat. No. 3,600,163 and tungsten carbide in aluminum, magnesium or zinc as disclosed by U.S. Pat. No. 3,583,471. These patents are incorporated herein by reference. In some cases, the concentration of third phase particles can be up to about 40 percent by weight.

In the present invention, the third phase particles can be added to the slurry composition in concentrations up to about 65 weight percent. The metal or metal alloy can be solid or partially solid and has up to 65 weight percent of a structure comprising degenerate dendritic or nodular primary discrete solid particles suspended in a secondary phase having a lower melting point than the primary particles which secondary phase can be solid or liquid. These compositions are formed by heating a metallic composition to a temperature at which most or all of the metallic composition is in a liquid state, and vigorously agitating the composition to convert any solid particles therein to degenerate dendrities or nodules having a generally spheroidal shape. Solid particles comprising the third phase of the composition are added to the liquid-solid metallic composition after all or a portion of the primary solids have been formed and the third phase particles are dispersed within the metal composition such as by agitation. After the third phase particles have been dispersed in the metallic composition, the melt can be cast to a desired form, or can be cooled to form a slug which can be formed or cast subsequently by heating and shaping. In any case the final formed composition contains primary solids.

The composition of this invention containing third phase particles can be formed from a wide variety of metals or alloys as set forth above in combination with nonmetallic or metallic third phase particles. The composition contains a secondary phase which can be either solid or liquid and a third phase which is solid, which third phase has a composition different from the primary solid particles and the secondary phase. The secondary phase is solid when the metal composition is solid and liquid when the metal composition is partially liquid.

The third phase of the compositions of this invention is formed by the solid particles which are added to the primary solid-secondary liquid phase slurry. For purposes of this invention, the composition of the particles forming the third phase can include any solid composition which normally is added to metal alloy compositions to change one or more physical characteristics of the metal alloy composition so long as it is wet by the metal alloy composition. Representative suitable examples of solid particles include nickel-coated graphite, metal carbides, sand glass, ceramics, metal oxides such a thorium oxide, pure metals and alloys, etc. The compositions of this invention containing the third phase particles can have a greatly increased weight percentage of such particles for a wide variety of alloys as compared to the compositions obtained by presently available processes. The compositions that can be obtained in accordance with the invention contain these third phase particles homogeneously distributed within the basic metal alloy composition. Accordingly, this invention provides substantial advantages over the prior art in that the latitude available for changing the basic characteristics of metal alloy compositions is greatly widened and these characteristic changes can be effected homogeneously throughout the metal alloy composition.

The weight percent of particles forming the third phase particles that can be added to a metal alloy can be varied widely. Higher weight percent of third phase particles can be added when the weight percentage of primary solids is relatively low. However, the primary particles should not be so small or widely distributed in the secondary phase as to present substantially no interaction with the third phase particles added. Generally, the primary particles should be present in the alloy in amounts of at least 5 weight percent and can vary up to about 65 weight percent.

During the particle addition step, the particles are added up to the capacity for the secondary phase to retain them and/or up to a weight fraction where the total weight fraction of primary particles and third phase particles does not exceed 65 percent. This capacity of retention of the third phase particles by the secondary phase is exceeded when the particles are observed to begin floating to the melt surface or sinking to the bottom of the melt. On the other hand, when the total weight percent of the primary solid particles and third phase particles exceeds 65 percent, the slurry viscosity increases and it behaves like a solid. The formation of additional liquid subsequent to the third phase particle addition does not effect the removal of the previously added third phase particles since they have had time to become wet by the secondary liquid phase and/or to intereact with the primary particles present therein so that they are retained in the metal composition. By operating in this manner, it is possible to attain up to about 65 weight percent third phase particle addition into the metal alloy. The preferred concentration of third phase particles depends upon the characteristics desired for the final metal composition and thus depends upon the metal alloy and particle compositions. The third phase particles are of a size which promotes their admixture to form homogeneous compositions and preferably of a size of between 1/100 and 10,000 microns.

It is desirable to attain uniform distribution of the third phase particles which can be controlled by increasing the degree and duration of mixing, employing relatively low rates of addition of the third phase particles and by controlling the weight percent of third particles added to the metal for a given weight of primary solids in the metal.

When the desired composition has been formed, which consists of primary solid-secondary liquid-third phase particles it can be cooled to form a solid slug or ingot for easy storage. Later the slug or ingot can be heated to a temperature wherein a primary solid-secondary liquid-third phase particle mixture is attained. Furthermore, a slug can be prepared which possesses thixotropic properties when reheated to the liquid-solid state. It can, thus be fed into a modified die casting machine or other apparatus in apparently solid form. However, shearing resulting when this apparently solid slug is forced into die cavity causes the slug to transform to a metal alloy whose properties are more nearly that of a liquid thereby permitting it to be shaped in conformance to the die cavity. A slug having thixotropic properties also can be obtained by cooling the primary solid-secondary liquid-third phase particle composition to a temperature higher than that at which all of the secondary liquid solidifies and the thixotropic composition obtained can be cast.

Alternatively, casting can be effected directly after the third phase particles have been successfully added to the primary solid-liquid mixture by pouring, injection or other means. The process disclosed is useful for die casting, mold casting, continuous casting, closed die forging, hot pressing, vacuum forming and other forming processes. The effective viscosity of the compositions therein and the high viscosity that can be obtained with the compositions of this invention result in less metal spraying in their entrapment in die casting and permits higher metal entrance velocities in this casting process. Furthermore, more uniform strength and more dense castings result from the present method.

We claim:

1. The method for forming a metal composition having solid discrete degenerate dendrites homogenously dispersed within a liquid phase of said metal composition which comprises:

a. heating a first metal composition to form a liquid-solid mixture of said first metal composition wherein less than about 65 weight percent thereof is solid and b. vigorously agitating said liquid-solid mixture to convert the solid therein to discrete degenerate dendrites derived from said first metal composition, said degenerate dendrites comprising up to about 65 weight percent of the heated metal composition and wherein the remainder of the heated metal composition is liquid.

2. The method for forming a solid metal composition containing discrete degenerate dendrites homogeneously dispersed within a secondary phase of said solid metal composition which comprises:

a. heating a first metal composition to form a liquid-solid mixture of said first metal composition wherein less than about 65 weight percent thereof is solid.

b. vigorously agitating said liquid-solid mixture to convert the solid therein to discrete degenerate dendrites derived from said first metal composition, said degenerate dendrites comprising up to about 65 weight percent of the heated metal composition and c. cooling said heated composition to solidify the liquid remaining after the degenerate dendrites are formed thereby forming a solid secondary phase of said metal composition.

3. The method for shaping a metal composition which comprises:

1. forming a metal composition having solid discrete degenerate dendrites homogeneously dispersed within a liquid phase of said metal composition by:

a. heating a first metal composition to form a liquid-solid mixture of said first metal composition wherein less than about 65 weight percent thereof is solid and b. vigorously agitating said mixture to convert the liquid-solid mixture therein to discrete degenerate dendrites derived from said metal composition, said degenerate dendrites comprising up to about 65 weight percent of the heated metal composition and wherein the remainder of the heated metal composition is liquid and 2. casting the heated metal composition comprising degenerate dendrites and liquid metal.

4. The method for forming a metal composition comprising a metal alloy matrix and third phase solid particles homogeneously suspended in said matrix, said metal alloy having solid discrete degenerate dendrites homogeneously dispersed within a secondary phase of said metal alloy which comprises:

a. heating a first metal alloy to form an initial liquid-solid mixture of said first metal alloy wherein less than about 65 weight percent thereof is solid, b. vigorously agitating said liquid-solid mixture to convert the solid therein to discrete degenerate dendrites comprising up to about 65 weight percent of said heated alloy and wherein the remainder of said heated metal alloy is a liquid secondary phase, c. adding solid third phase particles, having a surface that is wet by said metal alloy, to said alloy comprising degenerate dendrites and liquid secondary phase, and d. dispersing said third phase particles and said degenerate dendrites homogeneously in said secondary phase, said third phase particles comprising up to about 65 weight percent of the weight of the metal alloy and third phase particles.

5. The method of claim 1 wherein step (a) is conducted by heating the first metal composition above its liquidus temperature and thereafter cooling said first metal composition to form said liquid-solid mixture.

6. The method of claim 1 wherein step (a) is conducted by heating the first metal composition to a temperature below the liquidus temperature of said first metal composition to form said liquid-solid mixture.

7. The method of claim 5 wherein the liquid-solid mixture is cooled concomitant with said vigorous agitation to increase the proportion of said degenerate dendrites.

8. The method of claim 6 wherein the liquid-solid mixture is cooled concomitant with said vigorous agitation to increase the proportion of said degenerate dendrites.

9. The method of claim 7 wherein the liquid-solid mixture is cooled to form between 10 and 50 weight percent degenerate dendrites.

10. The method of claim 8 wherein the liquid-solid mixture is cooled to form between 10 and 50 weight percent degenerate dendrites.

11. The method of claim 2 wherein step (a) is conducted by heating the first metal composition above its liquidus temperature and thereafter cooling said first metal composition to form said liquid-solid mixture.

12. The method of claim 2 wherein step (a) is conducted by heating the first metal composition to a temperature below the liquidus temperature of said first metal composition to form said liquid-solid mixture.

13. The method of claim 11 wherein the liquid-solid mixture is cooled concomitant with said vigorous agitation to increase the proportion of said degenerate dendrites.

14. The method of claim 12 wherein the liquid-solid mixture is cooled concomitant with said vigorous agitation to increase the proportion of said degenerate dendrites.

15. The method of claim 13 wherein the liquid-solid mixture is cooled to form between 10 and 50 weight percent degenerate dendrites.

16. The method of claim 14 wherein the liquid-solid mixture is cooled to form between 10 and 50 weight percent degenerate dendrites.

17. The method of claim 3 wherein step (a) is conducted by heating the first metal composition above its liquidus temperature and thereafter cooling said first metal composition to form said liquid-solid mixture.

18. The method of claim 3 wherein step (a) is conducted by heating the first metal composition to a temperature below the liquidus temperature of said first metal composition to form said liquid-solid mixture.

19. The method of claim 17 wherein the liquid-solid mixture is cooled concomitant with said vigorous agitation to increase the proportion of said degenerate dendrites prior to being cast.

20. The method of claim 18 wherein the liquid-solid mixture is cooled concomitant with said vigorous agitation to increase the proportion of said degenerate dendrites prior to being cast.

21. The method of claim 19 wherein the liquid-solid mixture is cooled to form between 10 and 50 weight percent degenerate dendrites prior to being cast.

22. The method of claim 20 wherein the liquid-solid mixture is cooled to form between 10 and 50 weight percent degenerate dendrites prior to being cast.

23. The method of claim 3 wherein, prior to casting, the temperature of the liquid-solid mixture is reduced to increase the fraction of solid discrete degenerate dendrites while continuing to agitate vigorously until a desired ratio of liquid to degenerate dendrites is attained such that the mixture is thixotropic, ceasing said vigorous agitation of the thixotropic composition to gel the thixotropic composition and thereafter casting the thixotropic composition.

24. The process of claim 23 wherein the initial liquid-solid composition is formed by heating the first metal composition above its liquidus temperature and thereafter cooling said first metal composition.

25. The process of claim 23 wherein the initial liquid-solid composition is formed by heating the first metal composition to a temperaure below the liquidus temperature of said first metal composition.

26. The method of claim 4 wherein the initial liquid-solid mixture is cooled concomitant with said vigorous agitation to increase the proportion of said degenerate dendrites prior to adding said third phase particles.

27. The method of claim 26 wherein the initial liquid-solid mixture is cooled to form between 10 and 50 weight percent degenerate dendrites prior to adding said third phase particles.

28. The method of claim 4 wherein metal alloy is cooled to solidify said secondary phase and form a solid having said degenerate dendrites and said third phase particles homogeneously distributed therein.

29. The method of claim 26 wherein said metal alloy is cooled to solidify said secondary phase and form a solid having said degenerate dendrites and said third phase particles homogeneously distributed therein.

30. The method of claim 27 wherein said metal alloy is cooled to solidify said secondary phase and to form a solid having said degenerate dendrites and said third phase particles homogeneously distributed therein.

31. The method of claim 28 wherein said solid is heated to a temperature at which the solid is thixotropic and casting said thixotropic solid.

32. The method of claim 29 wherein said solid is heated to a temperature at which the solid is thixotropic and casting said thixotropic solid.

33. The method of claim 30 wherein said solid is heated to a temperature at which the solid is thixotropic and casting said thixotropic solid.

* * * * *